US008232104B1

(12) United States Patent
Frazier

(10) Patent No.: US 8,232,104 B1
(45) Date of Patent: Jul. 31, 2012

(54) VEHICLE DETECTION SYSTEM

(75) Inventor: Gary A. Frazier, Garland, TX (US)

(73) Assignee: Raytheon Company, Waltham, MA (US)

( * ) Notice: Subject to any disclaimer, the term of this patent is extended or adjusted under 35 U.S.C. 154(b) by 149 days.

(21) Appl. No.: 12/437,275

(22) Filed: May 7, 2009

Related U.S. Application Data

(60) Provisional application No. 61/052,512, filed on May 12, 2008.

(51) Int. Cl.
*G01N 37/00* (2006.01)

(52) U.S. Cl. ..... 436/56; 436/27; 436/164; 436/171; 436/172

(58) Field of Classification Search ..... None
See application file for complete search history.

(56) References Cited

U.S. PATENT DOCUMENTS

| | | | | |
|---|---|---|---|---|
| 5,018,866 | A * | 5/1991 | Osten | 356/417 |
| 5,760,394 | A * | 6/1998 | Welle | 250/303 |
| 2003/0118440 | A1 * | 6/2003 | Zhao et al. | 415/118 |

OTHER PUBLICATIONS

Moniz, E.J. et al, Approaches to combat terrorism (ACT): Opportunity for basic research, 2003, Report of a joint workshop exploring the role of the mathematical and physical science in support of basic research needs of the U.S. Intelligence Community.*
Zobov, N.F. et al. Infrared emission spectrum of hot D2O, 2006, Journal of molecular spectroscopy, vol. 240, pp. 112-119.*
Dawson, T. E. et al. Stable isotopes in plant ecology, 2002, Annual Review of Ecology & Systematics, vol. 33, pp. 507-559.*

* cited by examiner

*Primary Examiner* — Yelena G Gakh
*Assistant Examiner* — Robert Xu
(74) *Attorney, Agent, or Firm* — Christie, Parker & Hale, LLP

(57) ABSTRACT

One embodiment of the disclosure relates to a detection system including a chemical taggant and a detector. The chemical taggant may be a chemical not substantially present in an untagged target exhaust plume and able to be disposed in the exhaust system of a target and to enter the exhaust plume of the exhaust system in detectable quantities. The chemical taggant may have one or more distinct energy signatures, such as optical energy signatures, that allow its detection. The detector may be able to detect at least one of these one or more energy signatures of the chemical taggant in the exhaust plume. Another embodiment relates to a method of detecting a target by disposing a chemical taggant in the exhaust system of the target and then detecting the chemical taggant.

13 Claims, 4 Drawing Sheets

VEHICLE DETECTION SYSTEM

RELATED APPLICATIONS

This application claims priority to U.S. Provisional Patent Application Ser. No. 61/052,512, entitled "VEHICLE TRACKING SYSTEM," which was filed on May 12, 2008.

TECHNICAL FIELD OF THE DISCLOSURE

This disclosure generally relates to detection systems and tracking systems, and more particularly, to a vehicle tracking system that may be used to track the location of a vehicle over a period of time. In one embodiment, the tracking system may include a chemical taggant and a detection device.

BACKGROUND OF THE DISCLOSURE

Tagging systems that track vehicles have been devised. These tagging systems may include tagging devices, such as radio frequency (RF) tags or chemical tags that may be sprayed onto the vehicle's outer surface. These tagging devices may be detected by detectors over a period of time to monitor the location of the vehicle.

Radio frequency tags have a problem in that instruments may be used that allow the vehicle occupants or others to sweep the vehicle for the presence of these tags. These instruments may detect the presence of radio frequency tags due to one of several electromagnetic effects common to all radio frequency tags.

Chemical tags are similarly prone to detection by vehicle occupants or others not intended to detect the tag. One example of a chemical tag includes quantum dot devices dispersed in a solvent mixture that may be sprayed onto the vehicle's outer surface. When dried, the quantum dots may fluoresce at a particle optical frequency that can be detected by a remote optical detector. Quantum dots are dark in appearance, however, which may be relatively difficult to conceal on lightly colored vehicles. Other chemical tags may similarly have a distinctive color, may noticeably disturb dust or dirt when applied, or may otherwise be too readily detectable by the naked eye.

Current chemical tags for the outside of vehicles also suffer from the retention problems. Washing the vehicle may remove most or all of the taggant material.

SUMMARY OF THE DISCLOSURE

The current disclosure relates to a chemical taggant that may be placed in the exhaust system of a target such as vehicle having an internal combustion system to allow detection of the target. The disclosure also relates to systems for deploying and detecting the chemical taggants as well as detection devices.

The chemical taggant and detection systems of embodiments of the present disclosure may satisfy one or more of a variety of different needs outlined below:

- The chemical taggant may not be readily detected by the occupants of the vehicle.
- The chemical taggant may provide a persistent signal.
- The chemical taggant signal may be detectable at long range by a detection device.
- The chemical taggant may not be typically removed during the normal course of vehicle upkeep.
- The chemical taggant may remain effective for a lengthy period of time, or for a short period of time, as desired.

- The chemical taggant may substantially volatilize only when the vehicle is in operation and the exhaust system reaches a high temperature.
- The chemical taggant may exit the exhaust system of the vehicle in operation at a rate and in an amount to facilitate its detection.
- The detection device may be a specialized sensor, or it may be a readily available sensor.
- The detection device may be an optical sensor.

One of ordinary skill in the art will understand that not all chemical taggants, detection devices, detection systems, or methods of detecting a target will necessarily meet all of the above needs.

Accordingly, one embodiment of the current disclosure relates to a detection system including a chemical taggant and a detector. The chemical taggant may be a chemical not substantially present in an untagged target exhaust plume or atmospheric air. The chemical taggant may be able to be disposed in the exhaust system of a target and to enter the exhaust plume of the exhaust system in detectable quantities. The chemical taggant may have one or more distinct energy signatures, such as optical energy signatures, that allow its detection. The detector may be able to detect at least one of these one or more energy signatures of the chemical taggant in the exhaust plume.

Another embodiment of the current disclosure relates to a method of detecting a target by disposing a chemical taggant in the exhaust system of the target and then detecting the chemical taggant. The chemical taggant may have the properties described in the system above. It may be detected by detecting at least one of the one or more distinct energy signatures in the exhaust plume.

BRIEF DESCRIPTION OF THE DRAWINGS

A more complete understanding of embodiments of the disclosure will be apparent from the detailed description taken in conjunction with the accompanying drawings in which:

FIG. 4 illustrates a system and method for using periodic modulation to detect the chemical taggant.

DETAILED DESCRIPTION OF EXAMPLE EMBODIMENTS

It may be generally useful to provide a system and method that allow organizations, such as law enforcement or the military to mark a target such as a vehicle and then track the motion of the target over an extended period of time by detecting the target at multiple time points or continuously. The system may also allow these organizations to conclusively identify the target at a later point in time.

In general, embodiments of the present disclosure relate to a detection system and a method of using it. This detection system is primarily discussed herein as a vehicle tracking system or target tracking system, but one of ordinary skill in the art would be able to adapt components of the tracking system to non-tracking detection systems, such as a system for identifying a vehicle at a road block.

The detection system may include two primary components, a chemical taggant and a detection device (detector). The chemical taggant may be deposited in the exhaust system of a target such as vehicle having an internal combustion engine. The chemical taggant may be substantially not volatile or not detectable when the exhaust system is below a certain temperature normally only reached when the internal combustion engine is in operation and maintained only shortly after it has stopped.

For example, the chemical taggant may be a solid or a semi-solid at room temperature or may be contained in a substrate that is solid or semi-solid at room temperature. However, when the internal combustion engine is on, the chemical taggant may be volatilized in sufficient quantities to allow it to exit the exhaust system and be detected by the detection device.

Alternatively, the chemical taggant may be a multi-part system in which a first chemical deposited in the exhaust system reacts with air or exhaust gas when the internal combustion engine is in operation to produce a second chemical that is detected by the detection device. Various other chemicals may also be formed as intermediates in the process of reacting the first chemical to produce the second chemical.

Figure 1:
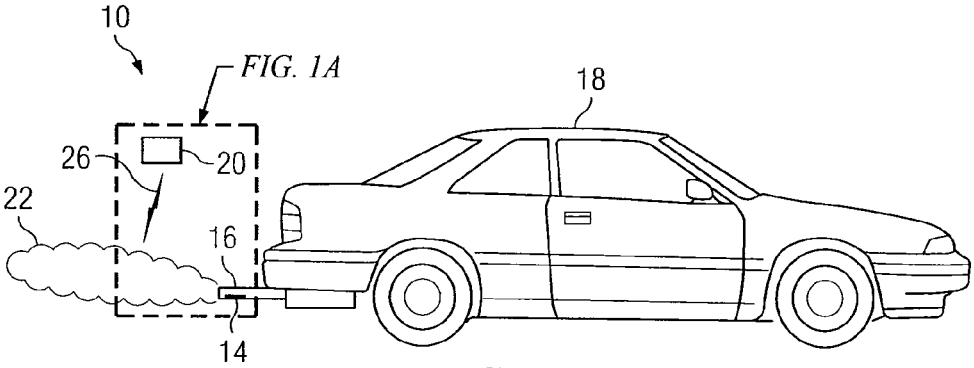
FIG. 1 illustrates a vehicle that may be tracked by one embodiment of a vehicle tracking system according to the teachings of the present disclosure.
Figure 1A:
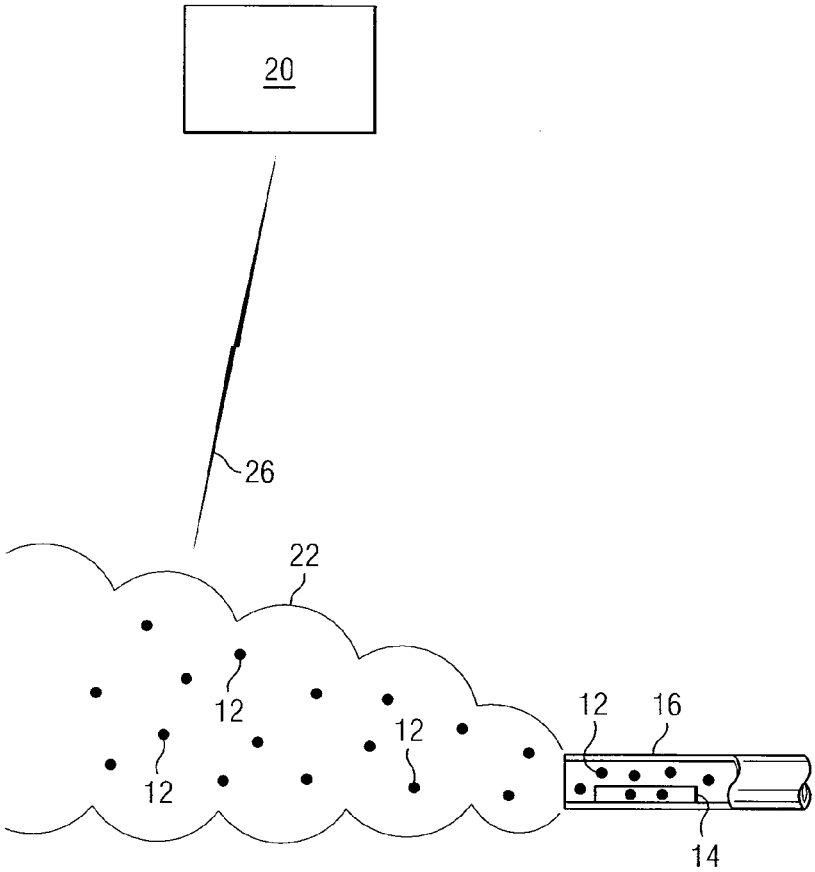
FIG. 1A illustrates a close-up view of FIG. 1.

FIG. 1 shows one embodiment of a target tracking system 10. Target tracking system 10 includes a chemical taggant 12 dispersed in a substrate 14 (which is optional in some embodiments) that is operable to be placed in an exhaust system 16, such as a tailpipe, of a vehicle 18. When vehicle 18 is operated, chemical taggant 12 may enter the exhaust plume 22 of vehicle 18. In the exhaust plume 22, chemical taggant 12 may emit or filter energy having characteristic properties that create an energy signature detectable by a detector 20. In this manner, the location of vehicle 18 may be monitored over a period of time following placement of taggant material 12 within the exhaust system 16 of vehicle 18.

Figure 2A:
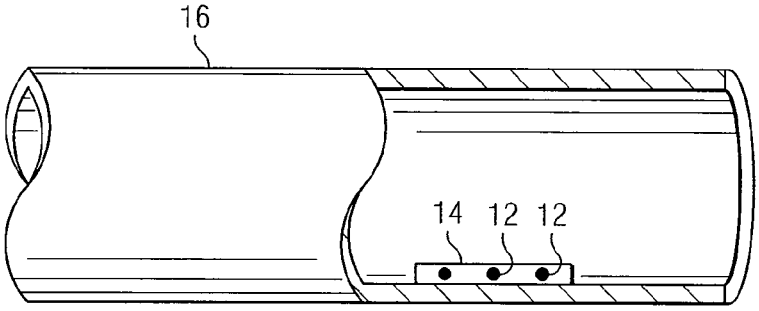
FIG. 2 illustrates the exhaust system containing the chemical taggant of one embodiment when the vehicle is not in operation (FIG. 2A) and when the vehicle is in operation (FIG. 2B) according to the teachings of the present disclosure.
FIG. 2C illustrates an exhaust system containing the chemical taggant of an alternative embodiment when the vehicle is not in operation according to the teachings of the present disclosure.
Figure 2B:
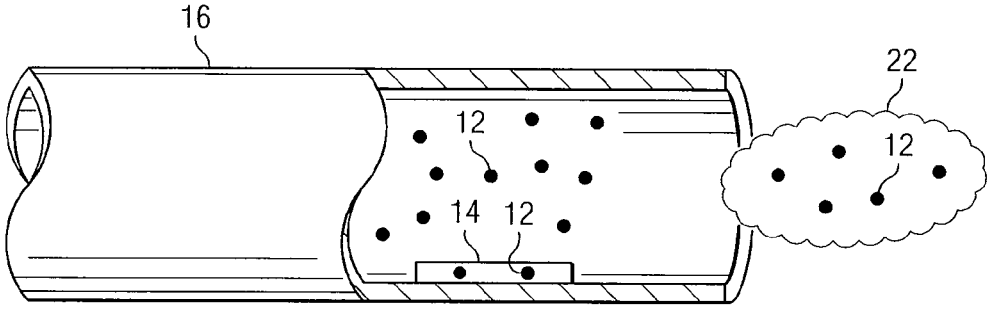

FIG. 2 provides a more detailed illustration of one embodiment in which chemical taggant 12 is present in exhaust system 16 (shown with optional substrate 14). When vehicle 18 has not been in operation for some time chemical taggant 12 is largely confined to exhaust system 16 and is substantially not volatilized. (FIG. 2A). When vehicle 18 is in operation or has very recently ceased operation, chemical taggant 12 is volatilized and leaves exhaust system 12 in exhaust plume 22. According to one embodiment, chemical taggant 12 may be considered substantially not volatilized when there is an insufficient amount of it present outside of exhaust system 16 to allow detection by detector 20. Chemical taggant 12 may considered volatilized when there is a sufficient amount of it outside of exhaust system 16 to allow detection by detector 20.

Figure 2C:
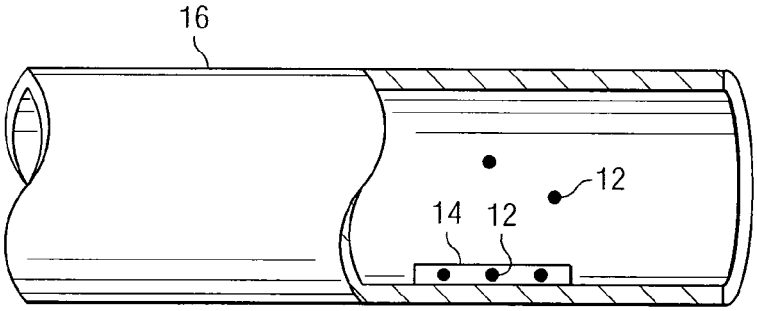

Although the embodiment shown in FIG. 2A allows preservation of the chemical taggant when the target is not is use, in other embodiments of the disclosure, and example of which is shown in FIG. 2C, chemical taggant 12 may be volatilized at any time and may be present in small amounts in the air in or around exhaust system 16 even when the target is not in use. This embodiment is functional so long as sufficient chemical taggant is present at some point in time in exhaust plume 22 of vehicle 18 to allow detection by detector 20.

According to one embodiment, the chemical taggant may be selected to have a boiling or vaporization point at or below the typical exhaust temperature of the target to facilitate its inclusion in the exhaust plume of the target. Any substrate containing the chemical taggant may also be selected to have a melting, boiling, or vaporization point at or below the temperature exhaust temperature of the target.

According to another embodiment, the chemical taggant may be selected so as to only substantially volatilize at temperatures above normal ambient temperatures for the target. For example the chemical may not substantially volatilize at temperatures below approximately 50° C. This may help avoid loss of the chemical taggant when the target is not in use.

According to other embodiments, the chemical taggant may be selected to not substantially volatilize until it reaches the typical exhaust temperature of a target vehicle. For example the chemical taggant may not substantially volatilize until it reaches approximately 600° F. to 700° F., which are typical idling exhaust temperatures for automobiles using an internal combustion engine. In applications where one wants to avoid volatilization when a vehicle is idling, the chemical taggant may not substantially volatilize until it reaches at least approximately 700° F. which is a typical in-motion exhaust temperature for automobiles using an internal combustion engine.

According to one embodiment, so long as the chemical taggant alters an energy property of the exhaust plume to create an energy signature, it may be detected. For example, the chemical taggant may emit energy or filter or otherwise alter ambient energy in a distinctive manner This energy may be optical energy. If optical energy in the form of visible light is altered, the chemical taggant may be selected to not alter the light in such a way that is easily detected by the naked eye.

In one embodiment, the chemical taggant may emit optical energy at the temperature typical of the exhaust gases of typical vehicles. That is, chemical taggant may remain relatively inert when the vehicle is not operating and increase its level of optical energy emissions under the influence of the relatively hot temperatures generated by exhaust gases. Example exhaust temperatures are provided above. Optical emissions may also be used to distinguish between idling and in-motion vehicles if desired. In particular embodiments, chemical taggants may be selected to cause distinguishable spectral shifts or emission spectra.

Any suitable type of chemical taggant may be used in various embodiments of the current disclosure. For example, deuterium oxide ($D_2O$) does not exist in high concentrations in the normal environment and has a very unique infrared signature when heated to its vapor state. This molecule may naturally and spontaneously emit optical energy at multiple infrared wavelengths when in its vapor state. The spectrum of optical energy emitted may be distinct from typical emissions produced by water ($H_2O$) molecules. Deuterium oxide is edible and presents no environmental hazard to humans, animals, or plants. Deuterium oxide may easily volatilize in the presence of typical exhaust gas temperatures (or at any temperature above 100° C.). Deuterium oxide is easy to transport. It may also be incorporated into forms that facilitate insertion into exhaust systems, such as substrates.

Other examples of suitable chemical taggants include alcohols, low molecular weight polymers, and aromatic hydrocarbons. These substances can be selected to have relatively small amounts of aroma or levels that match that of the normal emissions from the target, thus making olfactory detection of the chemical taggant difficult.

Isotopes of common elements may also be used in the chemical taggant. For example, isotopes of carbon or oxygen can be incorporated into the chemical taggant so that when volatilized, they may be detected using shifts in their emission spectrum relative to the more naturally occurring isotopes. Isotopes may be selected so as to be uncommon in the natural environment, but not so uncommon as to be prohibitively expensive. For example, oxygen-17 or oxygen-18 may be used because they occur infrequently compared to oxygen-16, but are still easier and less expensive to produce than other possible isotopes. Isotopes may be selected to avoid radioactive isotopes. For example carbon-13 may be used instead of radioactive carbon-14, even though both are rare compared to carbon-12.

In one example, the isotopes may be incorporated into a simple molecule such as polyethylene. Polyethylene is small chemical compound containing only two elements, carbon and hydrogen. At sufficient temperatures (typically above the heat of volatilization of the polyethylene polymer) this polymer will volatilize and enter the exhaust plume. If the polymer contains an unusual carbon isotope, it will also enter the exhaust plume with as part of the volatilized ethylene or polyethylene and may be detected by distinguishing spectral shifts caused by the isotope.

Figure 3:
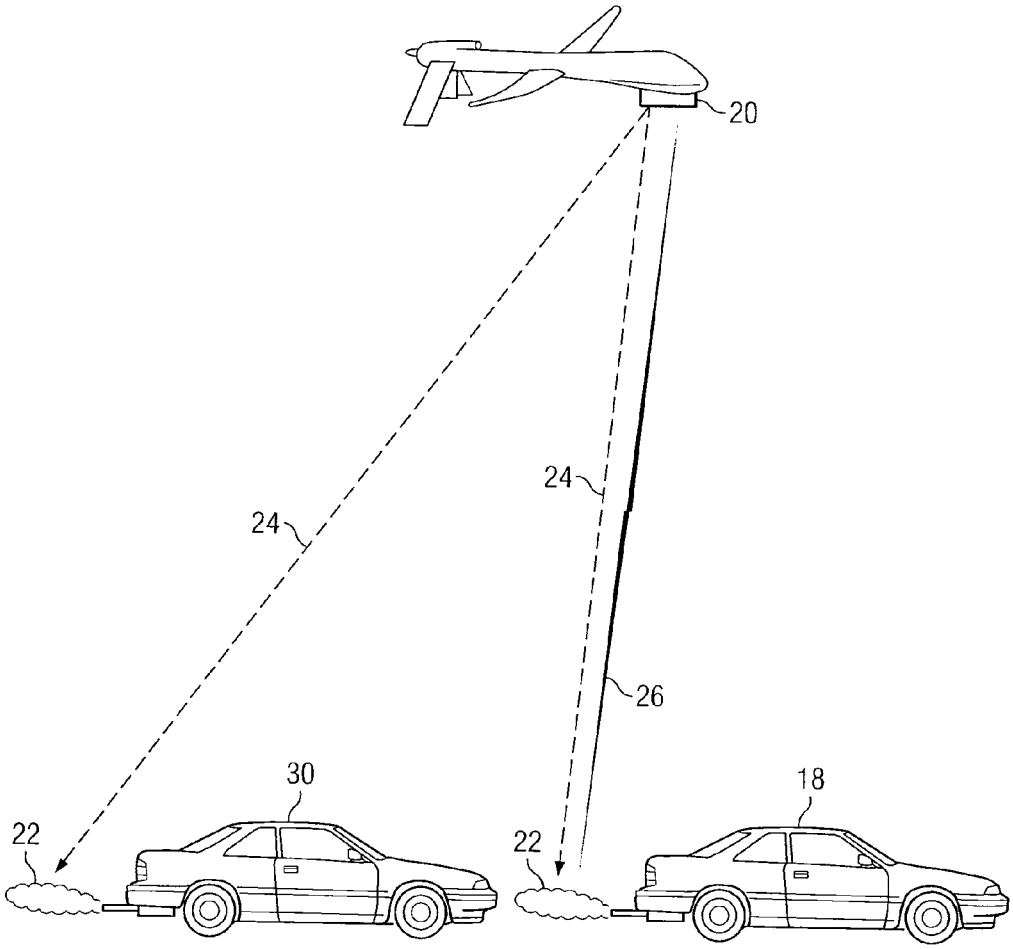
FIG. 3 illustrates the use of an active detection system of one embodiment as well as the ability of one embodiment to distinguish between tagged and untagged vehicles according to the teachings of the present disclosure.

In another set of embodiments, the chemical taggant may fluoresce in the presence of an external light source, such as a stimulating light source such as a laser or other suitable external light source. (For example, as shown in FIG. 3.) The fluorescent chemical taggant may be selected and applied in concentrations such that light sources common in a vehicle's environment, such as sunlight, headlights, or floodlights do not cause levels of fluorescence detectable by the naked eye. In this particular embodiment, the chemical taggant may be generally insensitive to the temperature of the exhaust gases for detection purposes and thus may be detectable as long as the chemical taggant in the exhaust plume is sufficiently concentrated to allow taggant fluorescence to be recovered from optical background.

In one embodiment, quantum dots may be used as the chemical taggant. Quantum dots are nanometer-sized particles that absorb and emit light at specific wavelengths. For example, a cubic millimeter of Indium Gallium Arsenide may be divided into approximately 100,000,000 dots. Each dot may have a relatively strong optical absorption at one wavelength and similarly strong optical emission at a different wavelength. The efficiency of quantum dots in converting input photons to output photons can be over 10 percent. This may be due to the high oscillator strengths associated with quantum confined structures. These dots may be integrated into a substrate, such as a polymer or other material such that hot exhaust gases of the exhaust plume carry the dots out of the exhaust system and into free space where they may be stimulated and detected according to their emission spectrum.

The external light source used to stimulate the quantum dots array may be the sun and/or a man-made source such as a laser. In one embodiment in which the external source is a laser, the light generated by the laser may be pulsed so that the detector may use phase-lock demodulation and averaging techniques to improve the stand-off detection range of the chemical taggant.

According to another set of embodiments, the chemical taggant may be a multi-part system in which the chemical applied in the exhaust system is different from the chemical that leaves the exhaust plume. One or more chemical reactions may occur in order to produce the chemical or set of chemicals that leave the exhaust plume.

For example, a first chemical that is not easily volatilized may be placed in the exhaust system where it may undergo a chemical reaction with other chemicals in the nearby air to form a second chemical that is more easily volatilized. If the first chemical contains, for example, an unusual isotope as described above, that isotope may then be present in the exhaust gas because it is incorporated in the second chemical. It is also possible for multiple different chemical reactions to occur, so that second, third, etc. chemicals all containing the unusual isotope are present in the exhaust gas.

In other embodiments, the first chemical may only undergo the chemical reaction(s) to form the second chemical at a substantial rate when the vehicle is in operation. For example, the first chemical may be selected to only react with the surrounding air (which may include exhaust gasses) at certain temperatures not normally reached by ambient air, but within the range of typical exhaust temperatures of the vehicle. As another example, the first chemical may not substantially react with atmospheric air (typically containing nitrogen gas, oxygen gas, argon gas, carbon dioxide, and water vapor), to produce substantial amounts of the second chemical, but may react with typical automobile or other internal combustion vehicle exhaust (typically containing nitrogen gas, carbon dioxide, water vapor, carbon monoxide, nitric oxide, and nitrogen dioxide). In one example the first chemical may react with something, such as a nitrogen oxide or carbon monoxide, present in exhaust but not normally present in appreciable quantities in atmospheric air. In another example, the first chemical may react with elements common to both atmospheric air and automobile exhaust, but which are present in much higher concentrations in exhaust, such as carbon dioxide, thereby increasing the amount of the second chemical produced when vehicle exhaust is present.

In various embodiments using any of the chemical taggants described above, the taggant or any substrate containing it may be in the form of polymers, waxes, gels, or viscous fluids. The chemical taggant may be selected to be non-toxic or to have limited or no toxicity at the concentrations released into the environment. Further, although only single taggants are discussed above, it is possible to combine multiple taggants to provide more distinctive taggant signatures or for other reasons.

Referring to FIGS. 1 and 3, detector 20 may include any type of sensor that detects energy, such as optical energy emanating from chemical taggant 12. Detector 20 may also include a filter that attenuates energy at wavelengths other than the those of optical energy emitted by the chemical taggant 12 or otherwise correlated with the energy signature of the chemical taggant 12. The filter may improve detection by suppressing background optical energy and thus increasing the signal-to-noise ratio of optical energy received by detector 20.

Detector 20 may be disposed on any suitable platform, such as a stationary platform or mobile platform such as another vehicle, an aircraft (shown in FIG. 3), such as an unmanned aerial vehicle, or a satellite that orbits the Earth.

Detector 20 may be able to detect and distinguish multiple chemical taggants 12, for example by using different filters or recognizing different energy signatures such as different optical spectra or fluorescence wavelengths. This may allow the separate detection or tracking of multiple vehicles 18 or identification of one or more of a group of chemical taggants.

According to the embodiment shown in FIG. 3, detector 20 may include emission equipment, such as a laser, to emit stimulating energy 24. When this stimulating energy 24 reaches a normal exhaust plume from untagged vehicle 30, no fluorescence correlated with chemical taggant 12 occurs. However, when stimulating energy 24 reaches tagged exhaust plume 22 of tagged vehicle 18, chemical taggant 12 emits fluorescent energy 26, which is detected by detector 20.

In an alternative embodiment, the stimulating energy may be supplied for a source other than detector 20. For example it may be sunlight or it may be sent from a separate emitter located in the same or a different location as detector 20.

Figure 4A:
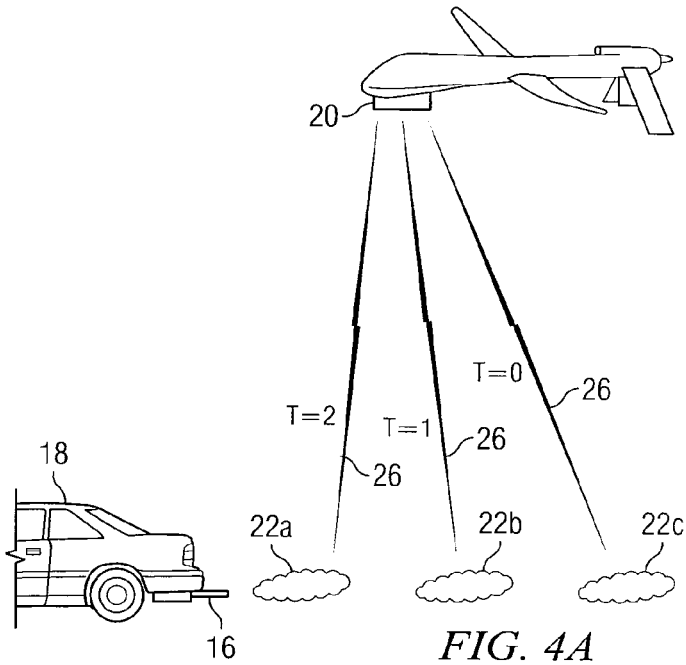
FIG. 4A illustrates a detection system and method.

FIG. 4 illustrates an embodiment in which detection may occur using periodic modulation. Generally internal combustion engines operate in a cyclical manner, which causes the exhaust gasses from these engines to be emitted from the vehicle 18 as an exhaust plume in a pulse-like manner. As a result, exhaust plume 22 as shown in FIG. 4A may actually include exhaust plume bursts 22*a*, 22*b* and 22*c*. This periodic emission of exhaust is easily observed on a cold day where the water content of the exhaust of a typical automobile can be seen to condense in a series of bursts or plumelettes when emitted form the exhaust system. Without a mechanical muffler, these periodic pulsations in the exhaust can also be heard as staccato pulses of sound. In one example embodiment of FIG. 4A, fluorescent energy 26 may be emitted or measured at times t=0, t=1, t=2, etc. corresponding to the exhaust plume bursts 22*c*, 22*b* and 22*a*.

Figure 4B:
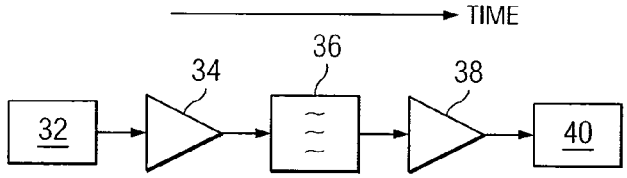
FIG. 4B illustrates a filtering detector.
Figure 4C:
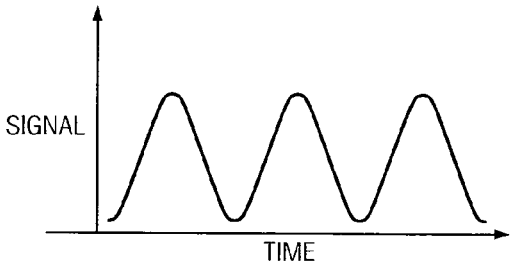
FIG. 4C illustrates and example filtered taggant signal.

In systems and methods using periodic modulation, the taggants described in this disclosure may be have a rapid response to changes in temperature such that they are volatilized and carried out of the exhaust system 16 at a mass rate that varies in time with the periodic pulses of exhaust plume 22*a*, 22*b* and 22*c* emitted by the internal combustion engine. In this type of embodiment the detection system may be able to more easily discriminate the fluorescence or absorption or other optical properties of the taggant from noise using electronic signal processing methods that operate on periodic rather than fixed (static) signals. FIG. 4B shows the components of detector 20 that may be used in such an embodiment. In particular optical detector 32 may be connected to electrical amplifier 34, which may be connected to bandpass filter 36, which may be a narrow bandwidth bandpass filter, which may be connected to amplitude detector 38, all of which together may process an optical signal 26 received by optical detector 32 to produce filtered taggant signal 40. FIG. 4C shows an example output of a such a system using periodic modulation. In FIG. 4C the filtered and detected taggant signal may be seen.

For example, if the taggant intensity were modulated at a 5 Hertz rate when the vehicle 18 is stopped and idling, a narrow bandwidth bandpass filter 36 centered on 5 Hz would preferentially pass the taggant signal while suppressing signals, including noise, at other frequencies. Therefore this method of detection may increase the signal-to-noise ratio of the taggant signal 40 relative to detection methods that do not exploit the periodic modulation of the taggant signal.

As described above, the chemical taggant may be detected at any point after its application. For example, it may be detected at multiple time points or continuously to allow tracking of the target. It may also be detected at one specific point in time to allow identification of the target. The extent of time between when the chemical taggant is applied an any detection event may vary depending on the taggant used. For example, it may be one hour, one day, one week, one month, or longer. The chemical taggant and detection equipment may be selected to allow detection for as long as needed.

One may determine how long a chemical taggant may be detected by applying it to the exhaust system of a test vehicle then determining how long it can be detected. Detector efficiency and the effects of different conditions, such as higher or lower ambient temperatures, frequency of target use, or weather may also be tested in such a straightforward manner. Simulations of test vehicle exhaust systems may also be used for testing.

In some situations, it may be useful to apply multiple chemical taggants with different detection lives or a taggant whose energy signature changes with time or frequency of vehicle use to allow determination of how long ago the taggant was applied or how often the vehicle has been used.

The range at which the chemical taggant may be detected by the detector may also vary and may be altered by a number of factors. For example, to achieve long-range detection of the taggant it may be designed to be present in the exhaust plume at high concentrations, or a more sensitive detection device may be used, or both. Where detection by others is a concern, the detection range of the chemical taggant may be deliberately designed to be no more than a certain distance.

Specific detection ranges may include but are not limited to: up to 5 meters, for example for roadside detection, up to 100 meters for short-range detection, up to 500 meters for long-range detection, up to 10 kilometers for common aircraft detection, up to 20 kilometers for high altitude aircraft detection, or up to 250 kilometers for satellite detection.

Although the present disclosure has been described in several embodiments, a myriad of changes, variations, alterations, transformations, and modifications may be suggested to one skilled in the art, and it is intended that the present disclosure encompass such changes, variations, alterations, transformations, and modifications as falling within the spirit and scope of the appended claims. For example, although most embodiments herein relate to vehicles having internal combustion engines, one of ordinary skill in the art would be able to adapt some embodiments to vehicles that do not contain an internal combustion engine provided that the chemical taggant was heated to a sufficient temperature and expelled from the vehicle in a sufficient quantity to allow detection. Further, although most embodiments relate to vehicles, the detection systems could be used to detect other devices, for example they may be used to detect when certain industrial components are in use.

What is claimed is:

1. A detection system comprising:

a chemical taggant not substantially present in an untagged target exhaust plume or atmospheric air, the chemical taggant having one or more distinct energy signatures, the chemical taggant is operable to be placed in an exhaust system of a target, to decompose in the presence of exhaust gases of the target, and to enter an exhaust plume of the exhaust system in detectable quantities at sufficiently high temperature of the exhaust system when the target is operated; and a detector operable to detect at least one of the one or more distinct energy signatures of the chemical taggant in the exhaust plume to detect a movement of the target, wherein the chemical taggant comprises deuterium oxide ($D_2O$).

2. The system according to claim 1, wherein the detector comprises a filter that attenuates energy at wavelengths other than at least one wavelength corresponding with the distinct energy signature.

3. The system according to claim 1, further comprising a substrate containing the chemical taggant and operable to be placed in the exhaust system of the target.

4. The system according to claim 3, wherein the substrate is operable to release the chemical taggant at the exhaust plume temperature.

5. The system according to claim 1, further comprising a stationary platform on which the detector is disposed.

6. The system according to claim 1, further comprising a mobile platform on which the detector is disposed.

7. The system according to claim 6, wherein the mobile platform is selected from the group consisting of: another vehicle, an aircraft such as an unmanned aerial vehicle, or a satellite that orbits the Earth.

8. The system of claim 1, wherein the detector comprises at least one narrow bandwidth bandpass filter operable to discriminate at least one of the one or more distinct energy signatures of the chemical taggant in the exhaust plume from noise when the exhaust plume is emitted periodically.

9. The system according to claim 1, wherein the target comprises a vehicle having an internal combustion engine.

10. The vehicle tracking system of claim 9, wherein the system further comprises a tailpipe located in the exhaust system.

11. The system according to claim 10, wherein the chemical taggant is placed in the tailpipe.

12. The system according to claim 1, wherein the one or more distinct energy signatures comprise an optical energy signature.

13. The system according to claim 12, wherein the optical energy signature comprises a fluorescent energy signature.

* * * * *